US005479784A

United States Patent [19]

Dobmeier et al.

[11] Patent Number: 5,479,784

[45] Date of Patent: Jan. 2, 1996

[54] REFRIGERANT DISTRIBUTION DEVICE

[75] Inventors: Thomas J. Dobmeier, Baldwinsville, N.Y.; Thierry Jomard, Villeurbanne, France; Dennis Penge, Cicero, N.Y.

[73] Assignee: Carrier Corporation, Syracuse, N.Y.

[21] Appl. No.: 239,710

[22] Filed: May 9, 1994

[51] Int. Cl.[6] ..... F25B 41/06

[52] U.S. Cl. ..... 62/117; 62/511; 62/525; 62/527

[58] Field of Search ..... 62/115, 117, 511, 62/525, 526, 527

[56] References Cited

U.S. PATENT DOCUMENTS

| | | | |
|---|---|---|---|
| 2,220,831 | 11/1940 | Swart | 62/525 |
| 2,461,876 | 2/1949 | Boyle | 62/525 |
| 2,676,470 | 4/1954 | Streitz | 62/511 |
| 3,795,259 | 3/1974 | Brandin et al. | 62/525 X |
| 4,524,823 | 6/1985 | Hummel et al. | 62/527 X |
| 4,593,539 | 6/1986 | Humpolik et al. | 62/527 X |
| 5,062,280 | 11/1991 | Martin, Sr. . | |

*Primary Examiner*—Harry B. Tanner

[57] ABSTRACT

A vapor compression system having a mixing and distributing unit mounted in the refrigerant circuit between the system expansion valve and evaporator. The unit includes a mixing vane and a nozzle for directing a uniformly distributed two phase mixture into the evaporator.

12 Claims, 5 Drawing Sheets

REFRIGERANT DISTRIBUTION DEVICE

BACKGROUND OF THE INVENTION

This invention relates to a vapor compression refrigeration system and, in particular, to a refrigeration flow distributor for improving the performance of a vapor compression refrigeration system.

The vapor compression refrigeration system typically involves a pair of heat exchangers that are operatively connected into a circuit for circulating refrigerant through the units. One unit acts as an evaporator in the system while the other acts as a condenser. The suction side of a compressor is connected to the refrigerant outlet of the evaporator unit and is arranged to bring the refrigerant leaving the evaporator to a higher temperature and pressure before introducing the refrigerant into the condenser unit. In the condenser, the high pressure refrigerant is brought to a liquid state and it is then throttled to a lower temperature and pressure in an expansion device prior to being circulated through the evaporator unit. The two phase refrigerant mixture passing through the evaporator unit is brought into heat transfer relationship with a higher temperature substance, such as air or water, whereby the refrigerant absorbs energy from the higher temperature substance and thus produces the desired chilling.

The performance of the evaporator unit, and thus the overall performance of the system, is dependent to a large extent on the ability to uniformly distribute the two phase mixture throughout the evaporator unit. In the evaporator unit, the two phase mixture is typically routed through a series of parallel flow channels that are coupled to an inlet supply header. Some of the flow channels are stationed some distance from the refrigerant inlet and, because of poor distribution, receive more gas phase than those channels closer to the inlet. As a consequence, the heat performance of the unit is adversely affected and a nonuniform distribution of heat transfer occurs across the unit.

Efforts directed toward enlarging the evaporator units used in vapor compression systems in order to enhance the systems' performance have not proven to be very successful and have resulted in a considerable increase in the cost of these systems. Attempts have also been directed toward mounting restricted orifices or rings at the entrance to each refrigerant flow channel within a system's evaporator unit to improve refrigerant distribution within the unit and thus improve the system's performance. Here again, some improvement can be realized, but only at an increased cost. It has also been suggested that a flow distributor be mounted in the refrigerant supply line linking the expansion device and the refrigerant inlet to the evaporator unit. These devices, however, are for the most part difficult and costly to manufacture and cannot be retrofitted to existing systems.

SUMMARY OF THE INVENTION

It is therefore an object of the present invention to improve the performance of vapor compression refrigeration systems.

It is another object of the present invention to improve the distribution of a two phase refrigerant as it is being circulated through an evaporator unit.

It is a still further object of the present invention to provide a flow distributor for use in association with a vapor compression system evaporator unit that is relatively inexpensive and easy to manufacture and assemble.

Still another object of the present invention is to provide a refrigerant flow mixing and distributing unit that can be easily mounted in an existing vapor compression system at the entrance to the system evaporator.

These and other objects of the present invention are attained by means of a flow mixing and distributing unit for connecting the refrigerant inlet of an evaporator unit utilized in a vapor compression refrigeration system to an expansion device. The mixing and distributing unit includes a housing having a tubular body section, an expanded bell section at one end and a necked down section at the other end. A bushing having a predetermined sized orifice is mounted in the necked down section of the housing and a mixing vane is mounted within the body section. The body section of the housing is received in close sliding relationship with the refrigerant entrance to the evaporator unit and a leak tight joint is formed therebetween. A refrigerant inlet line is attached to the bell end of the housing and is connected to the expansion device whereby a two phase refrigerant mixture is delivered into said housing. The incoming flow is split into two radially disposed streams which are then recombined prior to entering the bushing orifice whereby a well mixed two phase refrigerant mixture is uniformly distributed across the evaporator unit.

BRIEF DESCRIPTION OF THE DRAWINGS

For a better understanding of these and other objects of the present invention, reference shall be made to the following detailed description of the invention which is to be read in association with the accompanying drawing, wherein.

DESCRIPTION OF THE INVENTION

Figure 1:
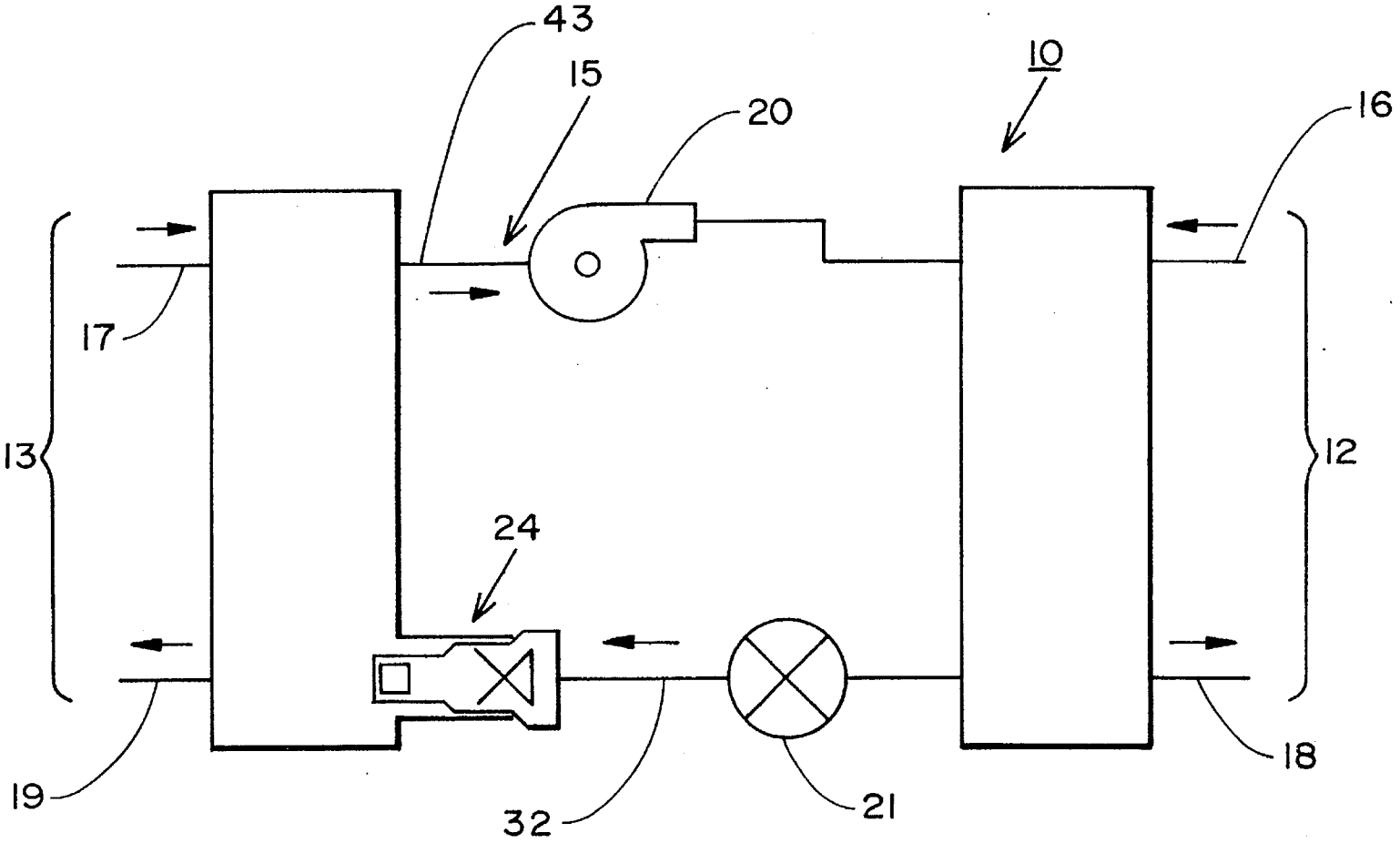
FIG. 1 is a schematic illustration of a vapor compression refrigeration system employing the teachings of the present invention.

With reference to FIG. 1, there is illustrated a vapor compression refrigeration system, generally referenced 10, which embodies the teachings of the present invention. The system includes a condenser unit 12 and an evaporator unit 13 both of which are preferably brazed plate units of the type widely used in the art. The heat exchangers are connected via a refrigerant flow circuit 15 arranged to circulate refrigerant through the units. Refrigerant passing through each unit is placed in heat transfer relation with water, or any other suitable substance that is brought into the units, via inlet lines 16 and 17 and discharged therefrom via discharge lines 18 and 19.

A compressor 20 is mounted in the refrigerant flow circuit between the heat exchanger units and is arranged to deliver refrigerant at a relatively high temperature and pressure into the condenser unit. The refrigerant gives up its heat energy to water passing through the condenser and is reduced to a liquid state. Upon leaving the condenser unit the refrigerant is passed through an expansion valve 21 wherein it is flashed rapidly to a lower pressure and temperature. The expansion valve separates the high pressure side of the system from the low pressure side.

The flashed or throttled refrigerant is circulated under the influence of the compressor through the evaporator unit where it is brought into heat transfer relationship with the substance to be chilled, which can be air, water, brine, or the like. As the refrigerant absorbs heat from the substance, the refrigerant will evaporate.

Liquid refrigerant that is passing through the expansion valve is flashed to a lower pressure and temperature resulting in a two phase mixture in which liquid phase droplets are carried in the gas phase. If the liquid phase is not uniformly mixed and distributed within the gas phase, the performance of the evaporator unit is seriously affected. In the present system, a refrigerant mixing and distributing assembly 24 is mounted at the refrigerant entrance to the evaporator downstream from the expansion valve. The operation of the mixing and distributing device will be explained below.

The mixing and distributing assembly 24 is shown in greater detail in FIGS. 2–5. The assembly includes a tubular housing 25 having a body section 26 with an expanded bell section 27 at one end and a reduced neck down section 28 at the opposite end. A bushing 31 is mounted in the necked down section of the housing while a mixing vane 33 is mounted in the body section of the housing.

Figure 2:
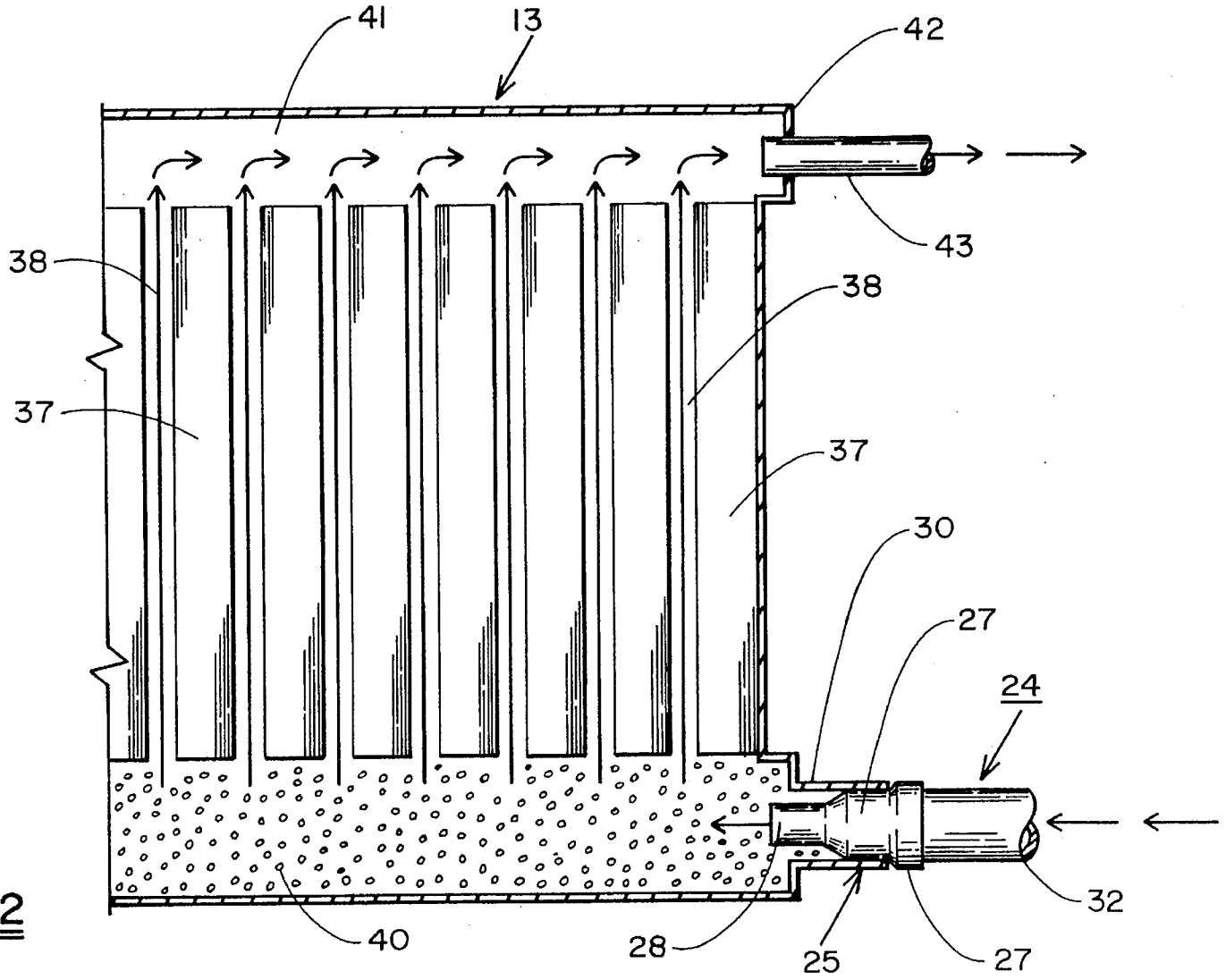
FIG. 2 is an enlarged partial side elevation in section showing the evaporator heat exchanger unit used in the system of FIG. 1.

As illustrated in FIG. 2, the mixing and distributing assembly 24 is mounted within the refrigerant entrance port 30 of the evaporator unit 13. The body section 26 of the housing is slidably received within the inlet port 30 and is soldered in assembly to establish a leak tight joint therebetween. The enlarged bell end 27 of the housing is situated outside the inlet port and is adapted to receive therein the distal end of a refrigerant supply line 32. The distal end of the supply line is brazed leak tight to the inner surface of the bell. Refrigerant flowing from the expansion valve 21 is thus caused to move through the mixing and distributing assembly as it enters the evaporator unit 13. Although the evaporator unit may take many forms, a brazed plate type unit is shown in FIG. 2. The heat exchanger contains a series of parallel water flow channels 37—37 that are interdisbursed between refrigerant flow channels 38—38. The refrigerant flow channels are mounted in fluid flow communication between the inlet header 40 of the unit and an outlet header 41. The outlet port 43 of the unit is, in turn, connected to the suction side of the compressor 20 by means of a suction line 43.

Figure 3:
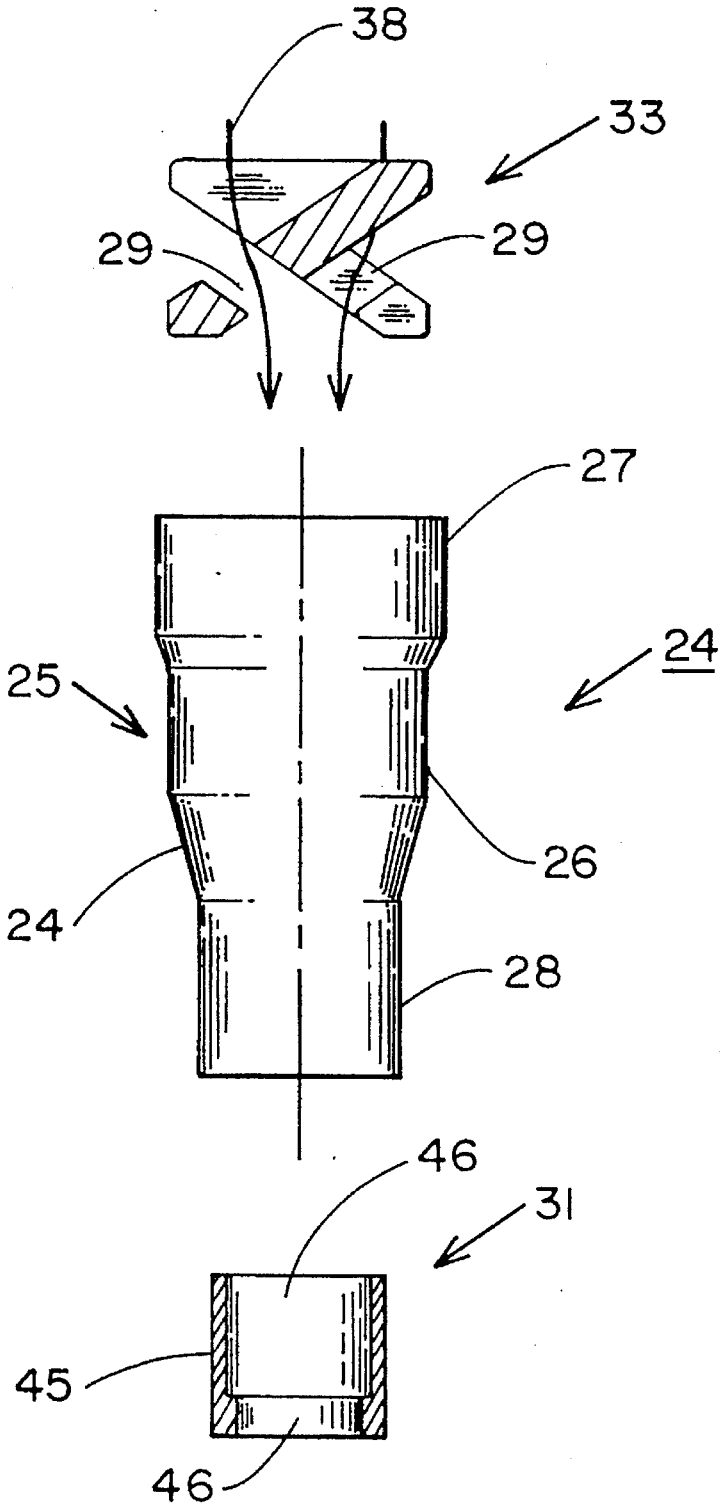
FIG. 3 is an enlarged exploded view showing refrigerant mixing and distributing assembly utilized in the system of FIG. 1.

The mixing vane 33 used in the mixing and distributing unit 24 is contoured to establish a close sliding fit with the inside diameter of the body section 26 of the housing 24. In assembly, the mixing vane is seated against the shoulder 34 of the housing and the body section is crimped inwardly to lock the mixing vane in place within the body section. The vane contains a pair of openings 29—29 that are arranged to divide the incoming flow of refrigerant into two separate radially disposed streams. The radially directed streams are then turned axially as indicated by the arrow 38 in FIG. 3. The streams are then recombined prior to passing downstream into the contracted end section 28 of the housing. Mixing vanes of the type illustrated in FIG. 3 are commercially available from Spraying Systems Co., of Weaton, Ill., which markets them under the tradename "FULLJET".

Figure 5:
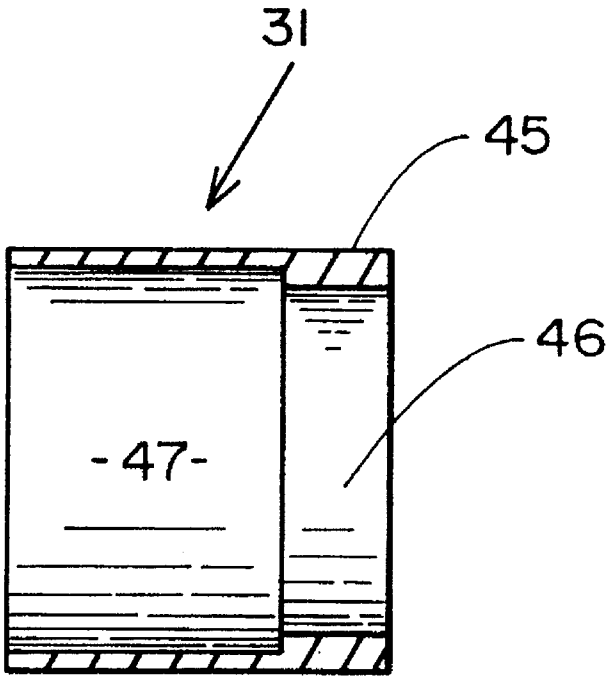
FIG. 5 is a sectional view taken along lines 5—5 in FIG. 4.
Figure 4:
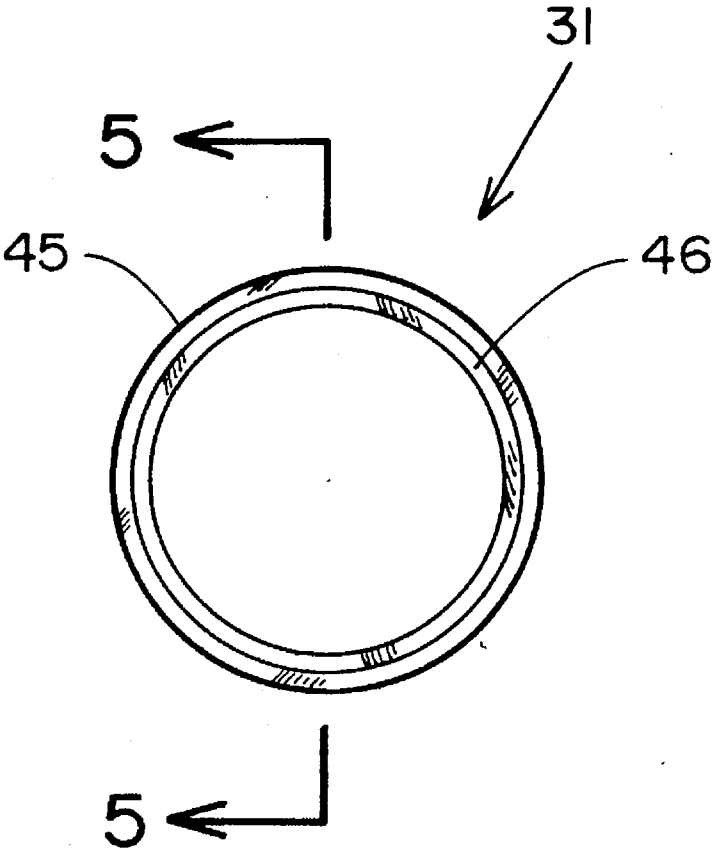
FIG. 4 is an enlarged end view of the bushing employed in the mixing and distributing assembly shown in FIG. 3.

As further illustrated with reference to FIGS. 4 and 5, bushing 31 includes a tubular member 45 having a flow passage 47 therein and an orifice 46 formed at the outlet end thereof. The orifice is formed to a desired size which is dependent upon the requirements of the system. In assembly the orifice is slidably positioned within the necked down end section 28 of the housing 25 with the orifice facing downstream in regard to the direction of flow. The bushing 31 is brazed within the end section to create a leak tight joint therebetween.

Refrigerant flow leaving the mixing vane is caused to pass through the bushing orifice which cooperates with the mixing vane to evenly distribute two phase mixture of refrigerant along the entire length of the refrigerant inlet header 40. As a result, the well distributed refrigerant mixture passes upwardly through the refrigerant flow channels of the evaporator unit thereby providing for enhanced heat transfer between the refrigerant and the substance being chilled. Tests have shown that the water temperature across an evaporator unit employing a mixing and distributing assembly of the type herein described remain at a relatively constant level when compared to similar units used in this type of system.

Figure 6:
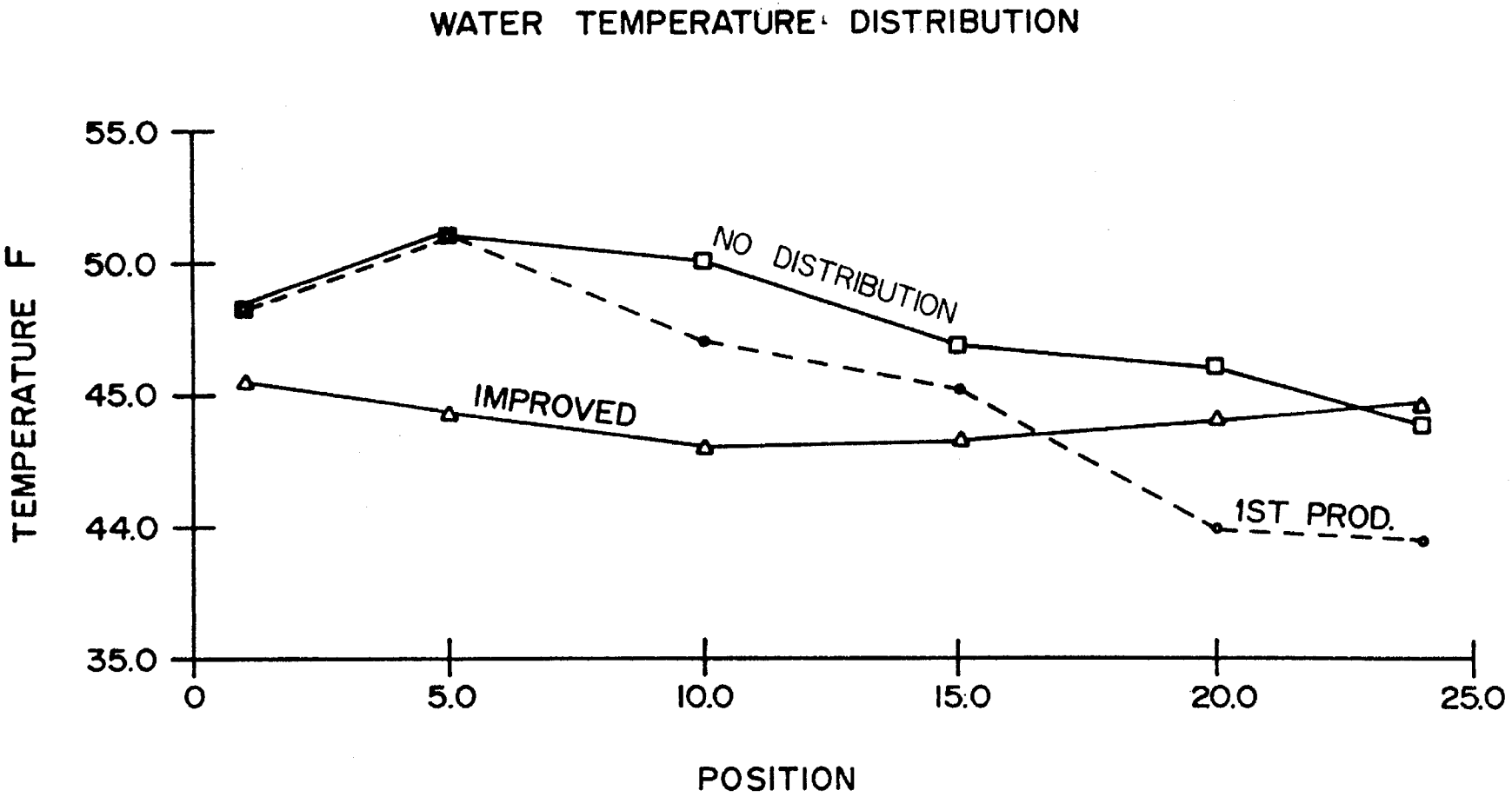
FIG. 6 is a graphic illustration of the performance of a refrigeration system with the present invention incorporated therein, as compared with that of one of the prior art.

As stated in the disclosure above it should be evident that the mixing and distributing assembly described herein is relatively inexpensive to manufacture and can be easily assembled and installed in new or existing vapor compression system. In addition, the bushing orifice size utilized in the device can be sized in response to the requirements of a given system thus providing a wider design capability than flow distributors that are presently in use. This is shown in FIG. 6, wherein the "improved" system, with the present invention incorporated therein, is relatively uniform in performance across the range of the various thermocouple positions as compared with that of two of the prior art systems without the distributing assembly of the present invention incorporated therein.

While this invention has been explained with reference to the structure disclosed herein, it is not confined to the details set forth and this invention is intended to cover any modifications and changes as may come within the scope of the following claims:

What is claimed is:

1. A method of connecting a refrigerant expansion device to the entrance port of an evaporator unit that includes the steps of providing a housing having a tubular body, an expanded bell section at one end of the body section and a necked down section at the other end of the body section;

mounting a bushing having an orifice means in the necked down section of the housing, mounting a mixing means in the body section of the housing, slidably mounting the body section of the housing within the entrance port of the evaporator unit; and connecting the bell end section of the housing to a refrigerant expansion device.

2. The method of claim 1 that includes the further step of slidably mounting a mixing vane within the body section of the housing and mechanically securing the vane in said body section.

3. The method of claim 1 that further includes forming a leak tight joint between the bushing and the necked-down section of the housing.

4. The method of claim 1 including the step of sizing the orifice in said bushing in regard to the demands of the evaporator unit.

5. The method of claim 1 that further includes forming a leak tight joint between the body section of the housing and the entrance port of the evaporator unit.

6. A refrigerant mixing and distributing assembly for connecting an expansion device to the entrance port of an evaporator unit used in a vapor compression refrigeration system that includes a tubular housing that is receivable within the entrance port of an evaporator unit;

coupling means for placing one end of the housing in fluid flow communication with a refrigerant expansion means;

a mixing vane mounted within the housing for acting upon a flow of refrigerant from said expansion means;

an orifice means mounted within said housing downstream from said mixing vane for directing refrigerant into said evaporator unit.

7. The assembly of claim 6 wherein said housing has a body section housing the mixing vane and a necked down section at one end of the body section housing the nozzle means.

8. The assembly of claim 7 wherein said mixing vane is slidably received within the body section and is locked in assembly by crimping said body section.

9. The assembly of claim 8 that further includes a bushing slidably mounted in the necked down section of the housing, said bushing having an orifice formed therein.

10. The assembly of claim 9 that further includes a leak tight joint formed between the bushing and the necked down section of the housing.

11. The assembly of claim 6 wherein said mixing vane has a plurality of flow paths for dividing and redirecting the refrigerant flow stream entering the housing.

12. The assembly of claim 7 wherein said housing further includes an expanded bell at the other end of said body section for receiving a supply line from said expansion device therein.

* * * * *